US009863250B2

(12) United States Patent
Heinemann et al.

(10) Patent No.: US 9,863,250 B2
(45) Date of Patent: Jan. 9, 2018

(54) FASTENER APERTURE HAVING AN ELONGATED GEOMETRY

(75) Inventors: Kurt R. Heinemann, North Berwick, ME (US); Mark David Ring, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 1569 days.

(21) Appl. No.: 12/711,791

(22) Filed: Feb. 24, 2010

(65) Prior Publication Data

US 2011/0206519 A1 Aug. 25, 2011

(51) Int. Cl.
*F01D 5/06* (2006.01)

(52) U.S. Cl.
CPC ..... *F01D 5/066* (2013.01); *F05D 2250/141* (2013.01); *F05D 2260/30* (2013.01); *Y10T 408/03* (2015.01); *Y10T 409/303752* (2015.01); *Y10T 428/24314* (2015.01)

(58) Field of Classification Search
CPC ..... F01D 5/06; F01D 5/066; F05D 2250/141; F05D 2260/30; Y10T 408/03; Y20T 428/24314
USPC ..... 416/224 A, 244 R, 220 R, 213 R; 403/353; 29/557, 889.21, 889.22; 415/214.1, 213.1
See application file for complete search history.

(56) References Cited

U.S. PATENT DOCUMENTS 2,340,396 A * 2/1944 McDonnell, Jr. ..... B64D 33/10 123/41.65
2,658,718 A * 11/1953 Walker ..... 416/97 R
3,545,885 A * 12/1970 Killam ..... F04D 29/36 416/207
3,791,471 A 2/1974 Buser
3,792,937 A * 2/1974 Chilman ..... B64C 11/32 416/137
4,066,372 A 1/1978 Swanson et al.
4,275,993 A * 6/1981 Sprengling ..... F04D 29/36 416/207

(Continued)

FOREIGN PATENT DOCUMENTS

WO WO 9741355 A1 * 11/1997 ..... F04D 29/263

OTHER PUBLICATIONS

Kalpakjian, S. and Schmid, S. "Manufacturing Processes for Engineering Materials" 2003 (New Jersey, Pearson Education, Inc.) Fourth Edition pp. 454-455, 466-467.*

(Continued)

*Primary Examiner* — Woody Lee, Jr.
*Assistant Examiner* — Joshua R Beebe
(74) *Attorney, Agent, or Firm* — O'Shea Getz P.C.

(57) ABSTRACT

An apparatus includes a substrate having one or more fastener apertures that extend therethrough. Each fastener aperture has a centerline and includes first and second circular segmented regions and a central channeled region. Each circular segmented region has a diameter and a segment length that extends along the centerline, wherein the segment length is greater than one-half the diameter. The central channeled region extends along the centerline between the first and the second circular segmented regions. The central channeled region has a height that is less than the diameter of the first and the second circular segmented regions.

21 Claims, 4 Drawing Sheets

(56) References Cited

U.S. PATENT DOCUMENTS

| | | | | |
|---|---|---|---|---|
| 4,630,999 | A * | 12/1986 | De La Harpe | F01D 7/00 416/147 |
| 4,901,523 | A | 2/1990 | Huelster | |
| 5,112,191 | A * | 5/1992 | Strock | B64C 11/06 416/129 |
| 5,236,172 | A | 8/1993 | Friemoth et al. | |
| 5,653,349 | A * | 8/1997 | Dana et al. | 211/189 |
| 6,213,245 | B1 | 4/2001 | Murata et al. | |
| 6,250,886 | B1 * | 6/2001 | Immell | F04D 29/388 416/214 R |
| 6,428,272 | B1 | 8/2002 | Pepi et al. | |
| 2006/0133938 | A1 * | 6/2006 | Ellis | F01D 5/027 416/144 |
| 2006/0188375 | A1 * | 8/2006 | Bussieres et al. | 416/220 R |
| 2006/0278463 | A1 | 12/2006 | Anzai et al. | |
| 2007/0234703 | A1 | 10/2007 | Uematsu et al. | |
| 2010/0226784 | A1 * | 9/2010 | Yao | 416/244 R |

OTHER PUBLICATIONS

McCauley et al. "Shop Reference for Students and Apprentices", pp. 138-139, Jan. 8, 2001.

* cited by examiner

FASTENER APERTURE HAVING AN ELONGATED GEOMETRY

BACKGROUND OF THE INVENTION

1. Technical Field

This disclosure relates to fastener apertures in general, and fastener apertures having an elongated geometry in particular.

2. Background Information

Traditional bolt holes have circular cross-sectional geometries. Circular bolt holes, however, are typically subject to relatively high stress concentrations. In order to reduce these high stresses, bolt holes can be configured having slotted geometries; e.g., elongated circular cross-sectional geometries, diamond shaped cross-sectional geometries, etc.

Slotted bolt holes are often formed using a milling process. For example, during the formation of an elongated circular bolt hole, a CNC milling machine begins removing material at a given point along the perimeter of the elongated circular geometry, and then finishes at the same point. Because of tolerances and machine runout, the milling machine almost never arrives at the exact coordinates of the starting point; i.e., the starting point and the ending point are almost always offset from one another. This offset ridge in the wall of the bolt hole creates a stress concentration that increases stress at that point. Additionally, depending on the tolerances of the CNC machine, this offset can be difficult to detect without using optical magnification equipment.

SUMMARY OF THE DISCLOSURE

According to a first aspect of the invention, an apparatus is provided that includes a substrate having one or more fastener apertures that extend therethrough. Each fastener aperture has a centerline and includes first and second circular segmented regions and a central channeled region. Each circular segmented region has a diameter and a segment length that extends along the centerline, wherein the segment length is greater than one-half the diameter. The central channeled region extends along the centerline between the first and the second circular segmented regions. The central channeled region has a height that is less than the diameter of the first and the second circular segmented regions.

According to a second aspect of the invention, a rotor stage is provided for a gas turbine engine. The rotor stage includes a disk, a plurality of blades, and at least one fastener aperture. The disk has a web extending between base portion and a rim. The blades are attached to the rim of the disk. The fastener aperture extends through the web. Each fastener aperture has a centerline and includes first and second circular segmented regions and a central channeled region. Each circular segmented region has a diameter and a segment length that extends along the centerline, wherein the segment length is greater than one-half the diameter. The central channeled region extends along the centerline between the first and the second circular segmented regions. The central channeled region has a height that is less than the diameter of the first and the second circular segmented regions.

According to a third aspect of the invention, a method is provided for manufacturing a fastener aperture having a centerline. The method includes the steps of: (i) providing a substrate; (ii) providing a first circular aperture that extends through the substrate, which first circular aperture has a diameter and a center disposed on the centerline; (iii) providing a second circular aperture that extends through the substrate, which second circular aperture has diameter and a center disposed on the centerline; and (iv) providing a central channeled region that extends through the substrate and between the first and the second circular apertures, which central channeled region has a height and a length that extends along the centerline. The diameters of the first and the second circular apertures are greater than the height of the central channeled region.

The foregoing features and advantages and the operation of the invention will become more apparent in light of the following description and the accompanying drawings.

DETAILED DESCRIPTION OF THE INVENTION

Figure 1:
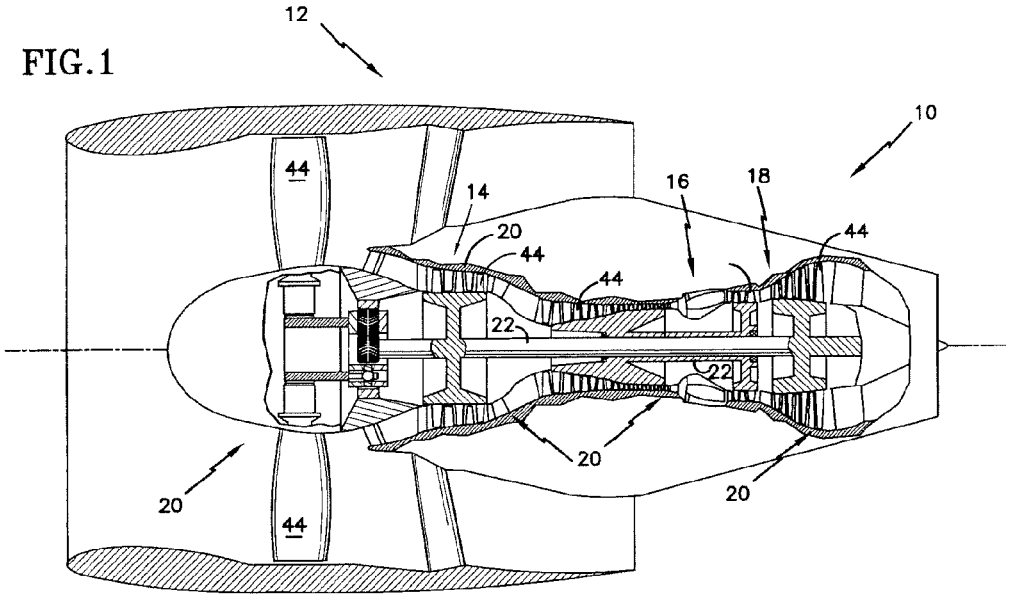
FIG. 1 is a side sectional diagrammatic illustration of one embodiment of a gas turbine engine.

Referring to FIG. 1, a gas turbine engine 10 includes a fan section 12, a compressor section 14, a combustor section 16 and a turbine section 18. The fan section 12, the compressor section 14 and the turbine section 18 each include one or more rotor stages 20 axially disposed along one or more engine shafts 22.

Figure 2A:
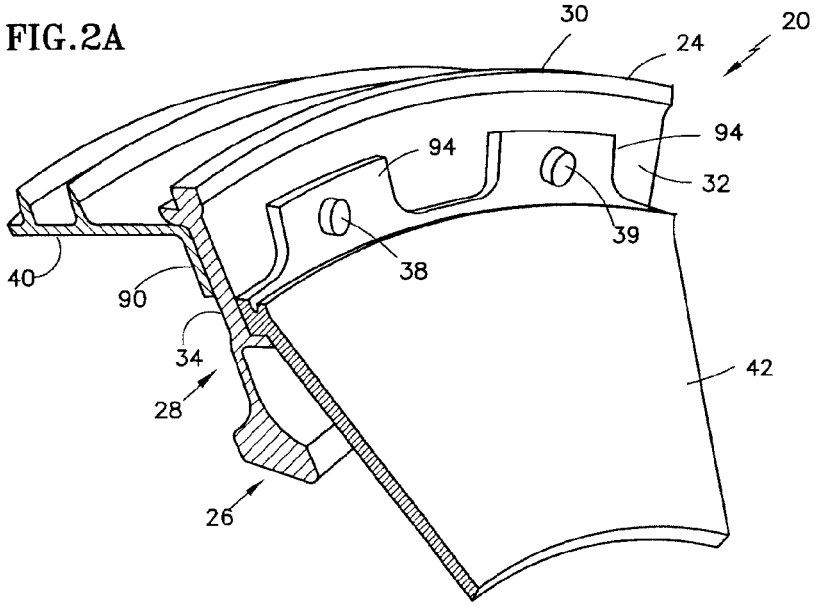
FIG. 2A is a partial perspective diagrammatic illustration of one embodiment of a rotor disk connected between a seal assembly and an engine shaft hub.
Figure 2B:
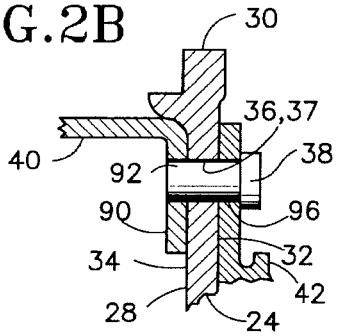
FIG. 2B is a side sectional diagrammatic illustration of the arrangement in FIG. 2A, including fasteners.

Referring to FIGS. 2A and 2B, each rotor stage 20 includes a rotor disk 24 having a bore 26, a web 28, and a rim 30. The bore 26 is disposed radially inside of the rim 30, and the web 28 extends radially between the bore 26 and the rim 30. The web 28 has a forward surface 32 and an aft surface 34. In the present invention, fastener apertures 36, 37 are described hereinafter as being disposed within the web 28 of the rotor stage 20, extending between the forward surface 32 and the aft surface 34. This embodiment is an example of an application of the present invention fastener apertures 36, 37, and the aforesaid apertures are not limited to this embodiment. In the embodiments shown in FIGS. 2A-2C, the present invention fastener apertures 36, 37 are shown used with fasteners 38, 39 adapted to attach a spacer arm 40 to the web 28 (e.g., see FIG. 2B), and adapted to attach the disk 24 to an annular hub 42. A plurality of blades 44 are attached to the rim 30 of the disk 24 (e.g., see FIG. 1), circumferentially spaced around the rim 30.

Figure 3A:
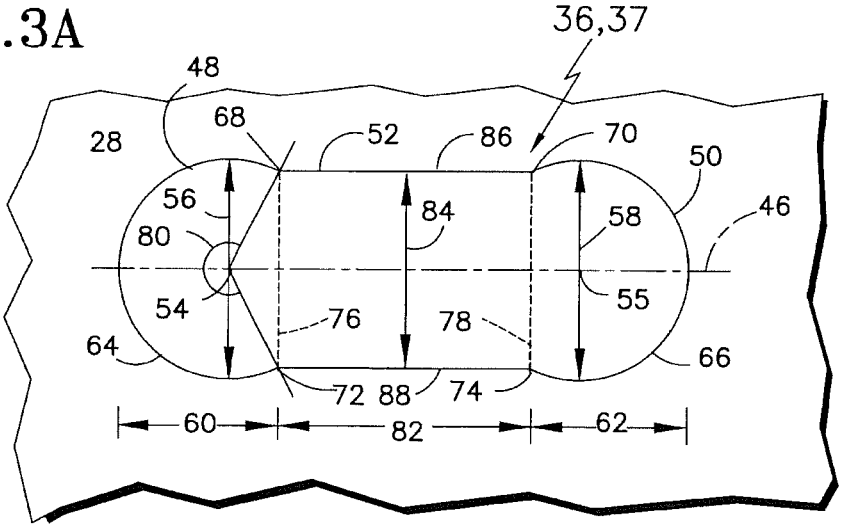
FIG. 3A is a frontal diagrammatic illustration one of the fastener apertures in the rotor disk.
Figure 3B:
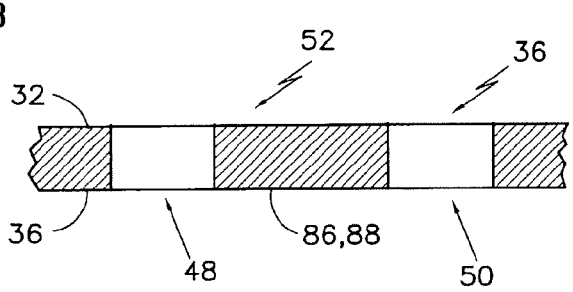
FIG. 3B is a side sectional diagrammatic illustration of fastener aperture in FIG. 3A.

Referring to FIGS. 3A and 3B, each fastener 38, 39 aperture has a centerline 46 and includes a first circular segmented region 48 (hereinafter the "first segmented region"), a second circular segmented region 50 (hereinafter the "second segmented region") and a central channeled region 52 (hereinafter the "channeled region").

Each segmented region 48, 50 has a center 54, 55, a diameter 56, 58, and a segment length 60, 62. Each segmented region 48, 50 has wall surface that defines an arcual plane 64, 66, extending between a first end 68, 70 and a second end 72, 74. A chord line plane 76, 78 extends between the first and second ends 68, 70 and 72, 74. The length of the chord line plane is defined as the distance between the first and second ends 68, 70 and 72, 74. The wall surface extends around the center 54, 55, at a distance out from the center equal to the radius (e.g., half the diameter 56, 58), between the first and second ends 68, 70 and 72, 74. Each segmented region wall surface extends an arc angle 80 that is greater than 180 degrees (or two radians). The chord line plane 76, 78 is disposed perpendicular to the centerline 46. In the embodiment shown in FIG. 3A, the diameters 56 and 58 of the segmented regions 48 and 50 are equal. The chord line plane length is less than the diameter 56, 58. The segment length 60, 62 is defined as a distance that extends from the chord line plane 76, 78, along the centerline 46 and through the center 54, 55, to a point that bisects the arcual plane 64, 66. In the present embodiment, the segment length 60, 62 is greater than half of the diameter 56, 58 (i.e., greater than the radius). The present invention, however, is not limited to the aforesaid configuration; e.g., in other embodiments, one of the diameters 56, 58 can be greater than the other one of the diameters.

The channeled region 52 extends along (e.g., parallel to) the centerline 46 between the chord line planes 76, 78 of the first and the second segmented regions 48 and 50 defining a length 82. In the embodiment shown in FIG. 3A, the channeled region length 82 is greater than the diameters 56, 58 of the first and the second segmented regions 48 and 50. The channeled region 52 has a height 84 that extends (e.g., perpendicularly to the centerline 46) between a first channel wall surface 86 and a second channel wall surface 88. The first channel wall surface 86 extends between the first ends 68 and 70 of the arcual planes 64 and 66 of the first and the second segmented regions 48 and 50. The second channel wall surface 86 extends between the second ends 72 and 74 of the arcual planes 64 and 66 of the first and the second segmented regions 48 and 50. In the embodiment shown in FIG. 3A, the channel height 84 is equal to the chord line plane lengths, and is less than the diameters 56 and 58 of the first and the second segmented regions 48 and 50. The first channel wall surface 86 and the second channel wall surface 88 are preferably parallel one another.

Figure 2C:
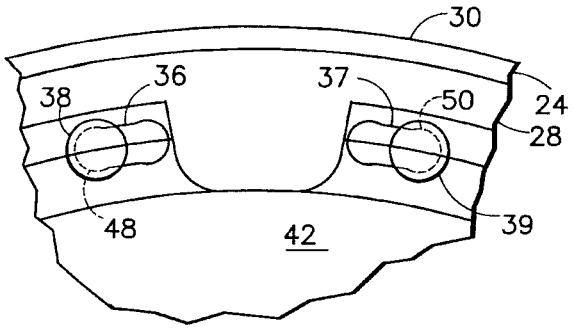
FIG. 2C is a frontal diagrammatic illustration of the arrangement in FIG. 2A that illustrates, via hidden lines, a plurality of fastener apertures in the rotor disk.

Referring again to FIGS. 2A and 2B, the spacer arm 40 includes a flange 90 with a plurality of fastener apertures 92. The fastener apertures 92 have a cylindrical geometry and are configured to align with the first and/or the second segmented regions 48 and 50 of the fastener apertures 38, 39 in the rotor disk 24. In a similar manner, the hub 42 includes a plurality of flanges 94, each with a fastener aperture 96. Each fastener aperture 96 has a cylindrical geometry and is configured to align with the first and/or the second segmented regions 48 and 50 of the fastener apertures 38, 39 in the rotor disk 24. The rotor disk 24 is connected to (e.g., clamped between) the spacer arm 40 and the hub 42 via a plurality of fasteners 38, 39 (e.g., bolts, etc.). In the embodiment in FIG. 2C, a first one 38 of the fasteners extends through the first segmented region 48 of a first one 36 of the fastener apertures in the rotor disk 24, and a second one 39 of the fasteners extends through the second segmented region 50 of a second one 37 of the fastener apertures in the rotor disk 24. As stated above, the spacer arm, hub and rotor stage embodiment shown in FIGS. 2A-2C are an example of an application of the present invention fastener apertures 36, 37 (disposed within the disk web 28), and the present invention is not limited thereto.

Figure 4A:
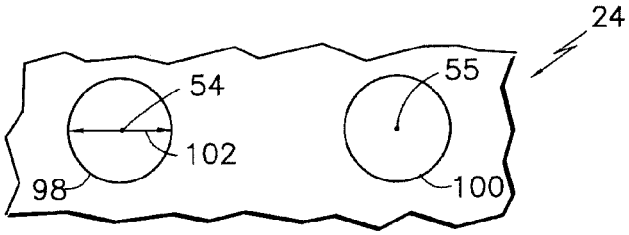
FIGS. 4A-4C diagrammatically illustrate one embodiment of a method for fabricating each of the fastener apertures in the rotor disk.
Figure 4B:
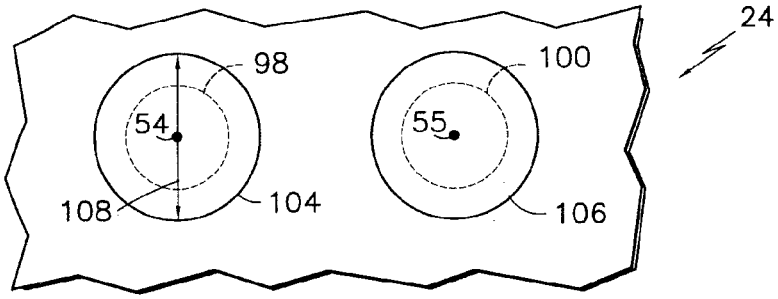
Figure 4C:
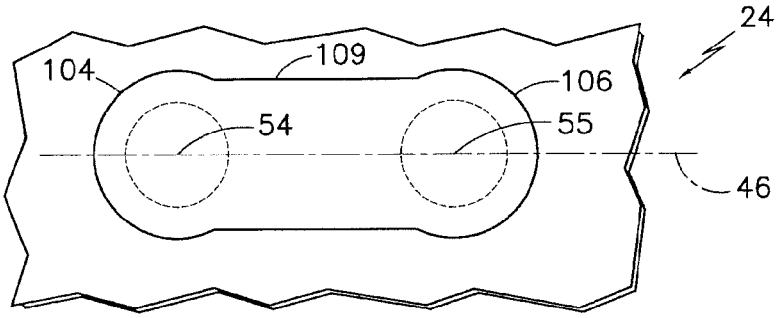

Referring to FIGS. 4A to 4C, a method for fabricating each fastener aperture in the rotor disk 24, or any other substrate, is provided as follows. Referring to FIG. 4A, a circular pilot aperture 98, 100 (hereinafter the "pilot aperture") is created in the rotor disk 24 at a point where the center 54, 55 for each segmented region 48, 50 is to be located. The pilot aperture 98, 100 has a diameter 102 that is less than the diameter 56, 58 of the segmented region 48, 50 to be formed. Referring to FIG. 4B, a circular primary aperture 104, 106 (hereinafter the "primary aperture") is created in the rotor disk 24 to concentrically enlarge each one of the pilot apertures 98, 100. The primary aperture 104, 106 has a diameter 108 that is equal to the diameter 56, 58 of the segmented region 48, 50 to be formed. Referring to FIG. 4C, a channel 109 is formed, through the rotor disk 24, that extends along the centerline 46 between the primary apertures 104, 106. The apertures 104, 106 and the channel 109 can be bored and formed using any suitable process such as, drilling, milling, single-point turning, etc.

Figure 5:
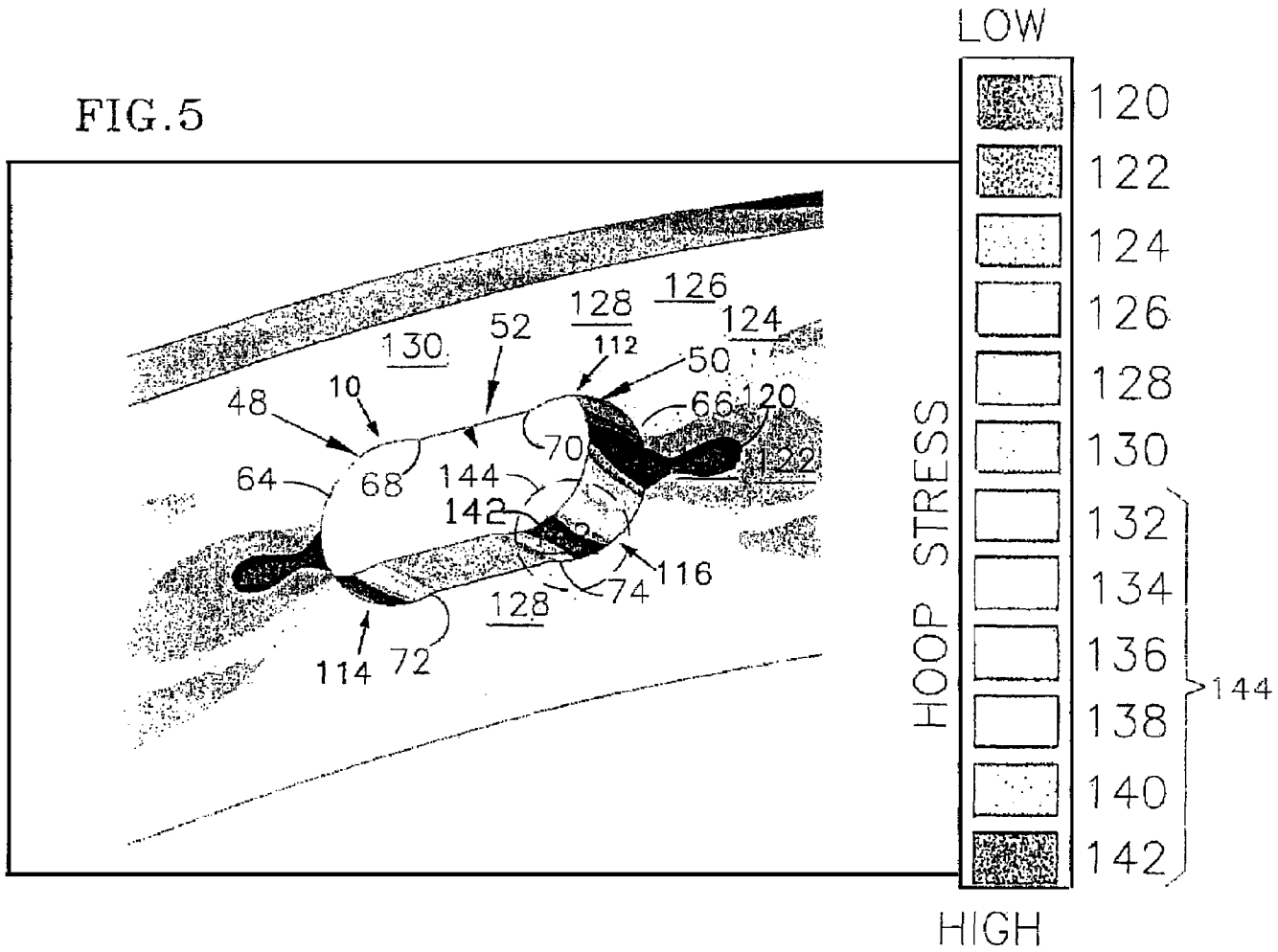
FIG. 5 is an exemplary hoop stress diagram illustrating effects of forces applied to the fastener aperture in FIG. 3A.

Referring to FIG. 5, an exemplary hoop stress diagram is shown for one of the fastener apertures 36, 37 in the rotor disk 24. In this example, equal and opposite forces are applied, along the centerline 46, to both ends of the fastener aperture. The diagram graphically illustrates how stress concentrations in material proximate the fastener aperture increase from a low stress region 120 to a high stress region 142. As illustrated, rotor disk material proximate the first segmented region 48 and the second segmented region 50 is subject to a relatively high stress concentration 142. Specifically, regions 110 and 112 proximate the first ends 68 and 70 of the arcual planes 64, 66 and regions 114 and 116 proximate the second ends 72 and 74 of the arcual planes 64 and 66 are subject to the relatively high stress concentrations. In contrast, rotor disk material proximate to the channeled region 52 is subjected to a relatively low stress concentration 128. To maximize the rotor disk material strength proximate the first and the second segmented regions 48 and 50 (i.e., the material that is subject to the greatest stress concentration), the first and the second segmented regions 48 and 50 can be bored via a single-point turning process. Notably, the inventors have found that such a single-point turning process can align fibers within the rotor disk material in such a way as to increase its fatigue strength relative to a comparable milling process. Therefore, in a preferred embodiment, the first and the second segmented regions 48 and 50 are bored via a single point turning process, while the channeled region 52 can be formed via a milling process since the rotor disk material proximate thereto is subject to relatively low stress concentrations. The present invention, however, is not limited to the aforesaid embodiment.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A rotor assembly for a gas turbine engine, comprising:
a rotor stage including:
a disk including a base portion, a rim and a web extending between the base portion and the rim;
a plurality of blades attached to the rim of the disk; and a rim fastener aperture extending through the web, the rim fastener aperture having a centerline and including:

first and second circular segmented regions, each circular segmented region having a diameter and a segment length that extends along the centerline, wherein the segment length is greater than one-half the diameter; and a central channeled region that extends along the centerline between the first and the second circular segmented regions, which central channeled region has a height that is less than the diameters of the first and the second circular segmented regions;

an annular hub axially engaging the web, the hub including a flange and a hub fastener aperture extending through the flange;

a fastener projecting through the rim and the hub fastener apertures, and axially securing the disk to the hub; and a spacer arm axially engaging the web;

the web disposed axially between the spacer arm and the hub;

the spacer arm including a spacer arm flange and a spacer arm fastener aperture extending into the spacer arm flange; and the fastener further projecting into the spacer arm fastener aperture, and axially securing the disk to the spacer arm;

wherein the hub projects radially inward and axially away from the web towards a distal end of the hub.

2. The rotor assembly of claim 1, wherein the centerline is straight.

3. The rotor assembly of claim 2, wherein the circular segmented region wall surface extends for an arc angle that is greater than 180 degrees.

4. The rotor assembly of claim 3, wherein the segment length extends between the chord line plane and the circular segmented region wall surface, through the center.

5. The rotor assembly of claim 4, wherein the height of the central channeled region extends between a first channel wall surface and a second channel wall surface.

6. The rotor assembly of claim 5, wherein the first channel wall surface extends between the first end of the first circular segmented region wall surface, and the first end of the second circular segmented region wall surface; and the second channel wall surface extends between the second end of the first circular segmented region wall surface, and the second end of the second circular segmented region wall surface.

7. The rotor assembly of claim 6, wherein the first channel wall surface is parallel with the second channel wall surface.

8. The rotor assembly of claim 1, wherein the fastener comprises a bolt.

9. The rotor assembly of claim 1, wherein the fastener is the only fastener projecting through the rim and the hub fastener apertures.

10. The rotor assembly of claim 1, wherein the spacer arm further includes a barrel portion and a seal element;

the barrel portion projecting axially away from the spacer arm flange; and the seal element projecting radially out from the barrel portion.

11. A rotor assembly for a gas turbine engine, comprising:

a rotor stage including a disk including a base portion, a rim and a web extending radially between the base portion and the rim;

a plurality of blades attached to the rim of the disk; and a plurality of rim fastener apertures extending through the web, each rim fastener aperture having a centerline and including:

first and second circular segmented regions, each circular segmented region having a diameter and a segment length that extends along the centerline, wherein the segment length is greater than one-half the diameter; and a central channeled region that extends along the centerline between the first and the second circular segmented regions, which central channeled region has a height that is less than the diameter of the first and the second circular segmented regions;

an annular hub axially engaging the web, the hub including a plurality of flanges and a plurality of hub fastener apertures, each of the hub fastener apertures extending through a respective one of the flanges; and a plurality of fasteners axially securing the disk to the hub, each of the fasteners projecting through a respective one of the rim fastener apertures and a respective one of the hub fastener apertures; and a spacer arm axially engaging the web;

the web disposed axially between the spacer arm and the hub;

the spacer arm including a spacer arm flange and a spacer arm fastener aperture extending into the spacer arm flange; and one of the fasteners further projecting into the spacer arm fastener aperture, and axially securing the disk to the spacer arm;

wherein the hub projects axially away from the web towards a distal end of the hub such that the distal end of the hub is located a minimum non-zero distance away from an entirety of the disk.

12. The rotor assembly of claim 11, wherein a first of the fasteners is disposed in the first circular segmented region of a first of the rim fastener apertures, and a second of the fasteners is disposed in the second circular segmented region of a second of the rim fastener apertures.

13. The rotor assembly of claim 11, wherein the fastener comprises a bolt.

14. The rotor assembly of claim 11, wherein the centerline is straight.

15. The rotor assembly of claim 14, wherein the circular segmented region wall surface extends for an arc angle that is greater than 180 degrees.

16. The rotor assembly of claim 15, wherein the segment length extends between the chord line plane and the circular segmented region wall surface, through the center.

17. The rotor assembly of claim 16, wherein the height of the central channeled region extends between a first channel wall surface and a second channel wall surface.

18. The rotor assembly of claim 17, wherein the first channel wall surface extends between the first end of the first circular segmented region wall surface, and the first end of the second circular segmented region wall surface; and the second channel wall surface extends between the second end of the first circular segmented region wall surface, and the second end of the second circular segmented region wall surface.

19. The rotor assembly of claim 18, wherein the first channel wall surface is parallel with the second channel wall surface.

20. The rotor assembly of claim 11, wherein each of the fasteners comprises a bolt including a bolt head and a bolt shaft that projects from the bolt head to a distal end of the bolt shaft, and each of the fasteners is uniquely associated with a respective one of the hub fastener apertures.

21. The rotor assembly of claim 11, wherein each of the fasteners comprises a bolt including a bolt head and a bolt shaft that projects from the bolt head to a distal end of the bolt shaft, and each of the hub fastener apertures receives a single respective one of the fasteners.

* * * * *